US005937457A

United States Patent [19]

Wang

[11] Patent Number: 5,937,457

[45] Date of Patent: Aug. 17, 1999

[54] CRADLE BASE COLLAPSIBLE MECHANISM

[75] Inventor: Sheng-Lung Wang, Taipei, Taiwan

[73] Assignee: Li-Ju Chen, Taipei, Taiwan

[21] Appl. No.: 09/156,656

[22] Filed: Sep. 18, 1998

[51] Int. Cl.[6] ..... A47D 13/06

[52] U.S. Cl. ..... 5/99.1; 5/98.1

[58] Field of Search ..... 5/98.1, 98.3, 99.1, 5/101

[56] References Cited

U.S. PATENT DOCUMENTS

| | | | |
|---|---|---|---|
| 4,008,499 | 2/1977 | Wren, Jr. et al. | 5/99.1 |
| 5,228,154 | 7/1993 | Brevi et al. | 5/98.1 X |
| 5,542,134 | 8/1996 | Wang | 5/99.1 |
| 5,697,111 | 12/1997 | Dillner et al. | 5/99.1 |
| 5,803,650 | 9/1998 | Wu | 5/99.1 |
| 5,819,342 | 10/1998 | Williams | 5/99.1 |

*Primary Examiner*—Michael F. Trettel

*Attorney, Agent, or Firm*—Smith, Gambrell & Russell, LLP; Beveridge, DeGrandi, Weilacher & Young Intellectual Property Group

[57] ABSTRACT

A cradle base collapsible mechanism, involving four sides at the bottom of a baby cradle, each side involving two support rods that are joined by a middle unit, each corner of the cradle involving a corner piece that is joined to another end of the support rod, the inside of each middle unit is joined with a middle rod, the other end of the middle rod is joined to one side of a center unit, one end of the middle rod facing the center unit is fitted with a bottom fixing unit, the fixing unit has a flange that is engaged to the rod opening, to the fixing unit is riveted a slide block, between the slide block and the fixing unit bottom is a spring, the oblique section at the front end of each slide block extending a fixing unit, in connection with a corresponding end of a pressing plate, when the pressing plate is lifted, the slide block will retract, and the middle rod will be pulled up and straightened accordingly, then the middle unit will be folded ninety degrees, so each support rod is pulled up and straightened, therefore, the two sides of the middle unit are joined with an opening facing outside and one end of the support rod.

5 Claims, 8 Drawing Sheets

CRADLE BASE COLLAPSIBLE MECHANISM

BACKGROUND OF THE INVENTION

The invention relates to a "cradle base collapsible mechanism", particularly to one involving a joint (connector) at the base of a baby cradle, which will fasten the structure securely in its engagement mode, and will be easily collapse and fold the structure after its engagement mode is disabled.

Conventionally, the construction of a baby cradle base involves a square frame and a cross structure, the two structures involve some problems in their carrying strength and collapsing process. Therefore, some have come up with improved structures, including reinforced cross bars on a cross structure, or an improved central joint at the center of the cross structure. Most important of all is that, to reduce the space for storage, such collapsible types of cradle construction involve many joints, so that all the rods can be collapsed. While the joint structure at each side involves only an up-and-down collapsible shape, once it is pulled up, the rod at said side will lose its balance. Some have come up with a square frame structure containing two bars at its center, as shown in FIG. 8. Here, a three-way joint 5 and two-way joint 6 respectively connected with a short rod 50 and a long rod 60. The long rod 60 and the short rod 50 are joined with a corner piece 10. The bottom ends of the main unit of the joints 50,60 are connecting legs, and the two ends of the main unit are openings facing down. Another side of the three-way joint 5 is an opening facing up, each rod and joint are riveted, so with only an upward pull, it will lose its stability, which will cause high risks to a baby. The conventional structures involve factors of insecurity, if said joint is replaced by a fixing type joint, each side of the structure must be depressed once in order to fold it for storage purpose. Moreover when a baby is playing in the cradle, it may touch or pull everything it sees here and there, so the joint may be depressed accidentally to pull up the rods 50,60, which collapses the cradle construction, and the baby will fall off. Therefore, it also involves safety concerns, its construction involves serious inconvenience, to redress such shortcomings, and therefore the inventor has devoted in the research and development of a "cradle base collapsible mechanism".

SUMMARY OF THE INVENTION

The primary objective of the present invention is to present a "cradle base collapsible mechanism", wherein the integral construction of a cradle base is shaped as a square frame containing a cross structure, the support rod on each side retracting slightly to become a "Z" shape to facilitate the accommodation of a base plate. The portion of base plate other than the edges are in connection with the rods, to strengthen its carrying capacity. An integrally designed center unit is provided, so that the engagement of all support rods will not be released until after the center unit is opened. By means of the middle units connected to the middle of the support rods on all sides, the rods on two sides are depressed, and the engagement of the support rods could not be released unless the middle rods in connection with the center unit are driven to drive the middle unit to turn ninety degrees upward. The whole unit involves some safety risks in its application, so some measures must be taken to prevent the support rods from being pulled up and outward before they are moved, to ensure that the middle rods connected to all sides of the center unit are accurately and simultaneously loosened only when the pressing plate in the center unit and its corresponding slide block are accurately pushed. It is desired for the operation to be controlled single-handedly, and for the operation to be accurate and safe.

To achieve the above purposes, the invention is so designed to involve four sides at the bottom of a baby cradle, each side being composed of two support rods that are joined by a middle unit, each corner of the cradle base being joined to the other end of support rod with a corner piece, the inside of each middle unit being connected to a middle rod, so the other end of each middle rod is connected to one side of a center unit, the end of the middle rod facing the center unit involving a base fixing unit, the fixing unit having a flange which is engaged to the rod opening, to the fixing unit is riveted a slide block, between the slide block and the fixing unit is a spring, at the front of each slide block is the extension of an oblique section fixing unit, in connection with a corresponding end of a pressing plate, when the pressing plate is lifted, the slide block retracts, the middle rod is pulled and straightened up accordingly, then the middle unit will turn ninety degrees, so all support rods are straightened up, therefore, the two sides of the middle unit are an opening facing outward to connect one end of the support rod.

To enable your better understanding of the integral construction, installation, characteristics and performance of the invention, the embodiment of the invention is described in details with drawings below:

DETAILED DESCRIPTION OF PREFERRED EMBODIMENT

Figure 1:
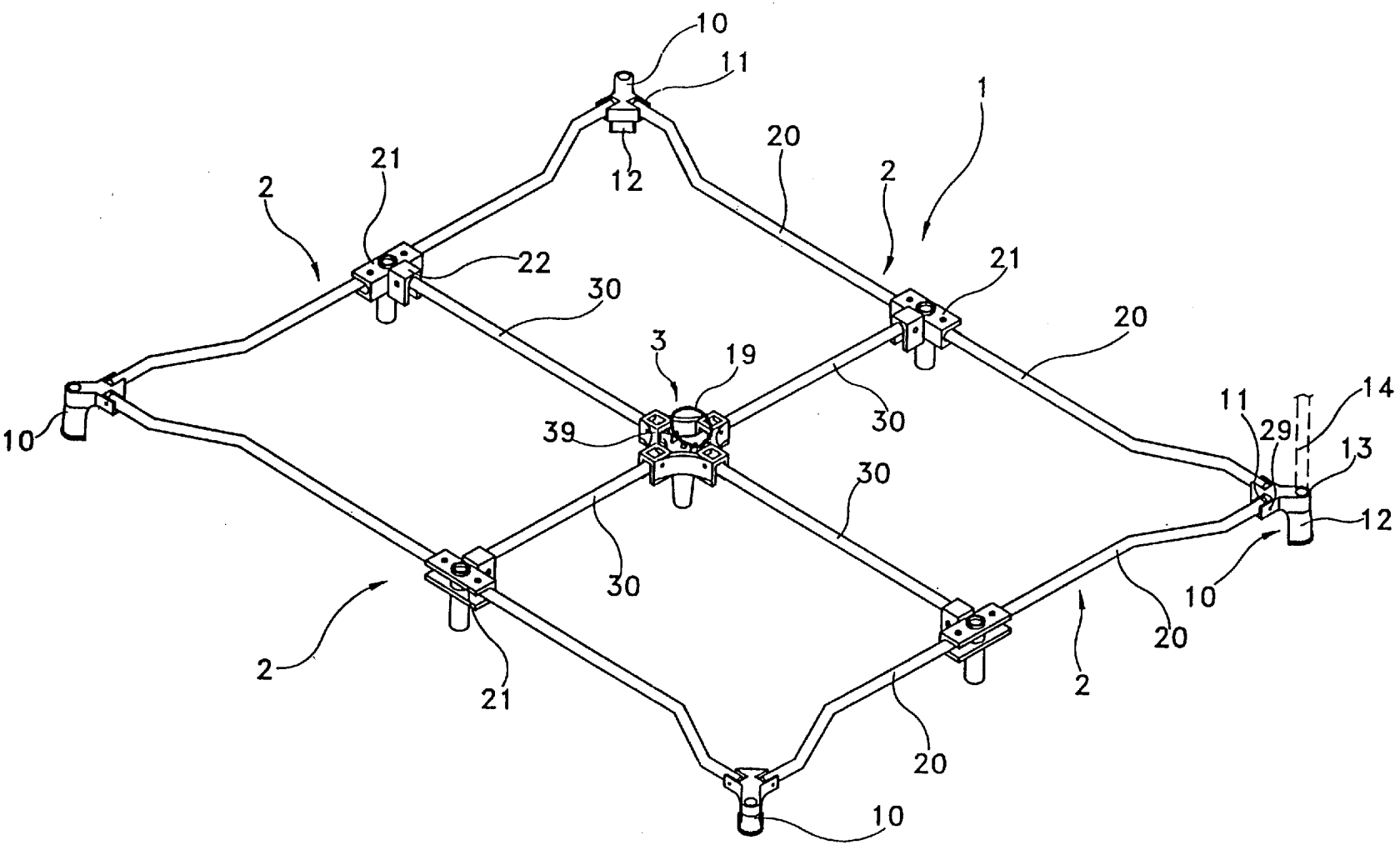
FIG. 1 is a perspective assembled view of the invention.
Figure 2:
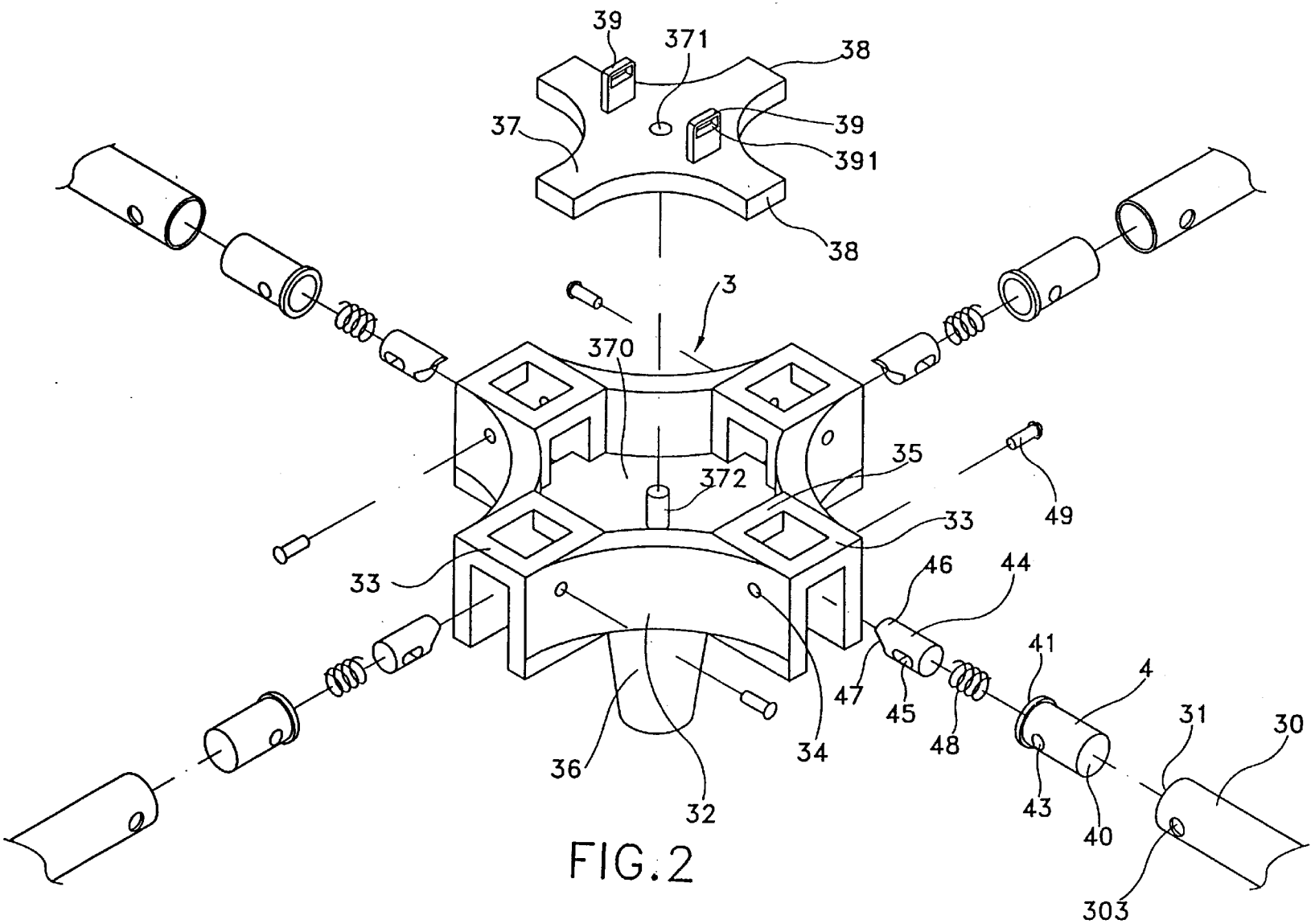
FIG. 2 is an exploded view of the center unit in the invention.
Figure 3:
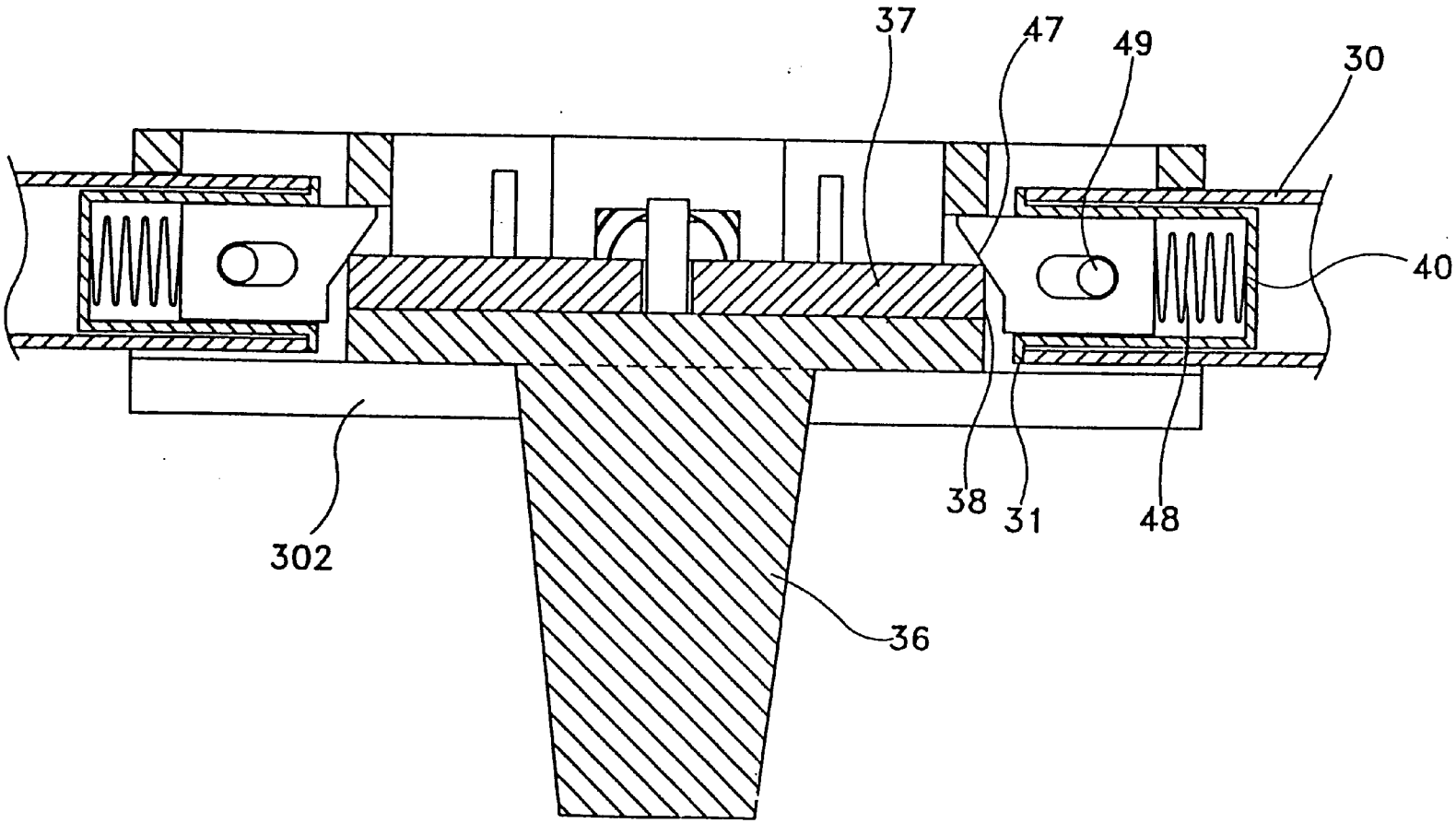
FIG. 3 is a sectional view of the center unit in the invention.
Figure 4:
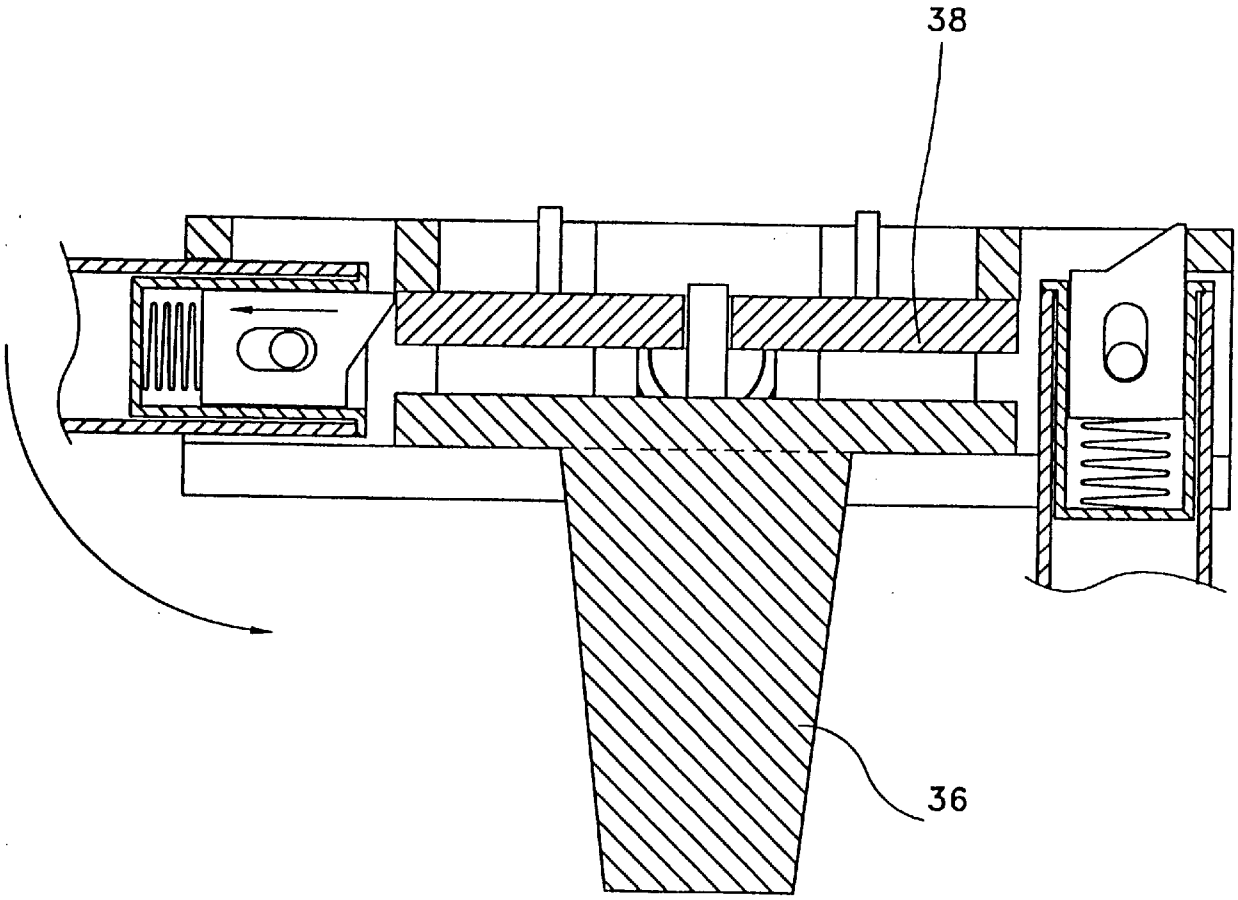
FIG. 4 is an operating view of FIG. 3.
Figure 5:
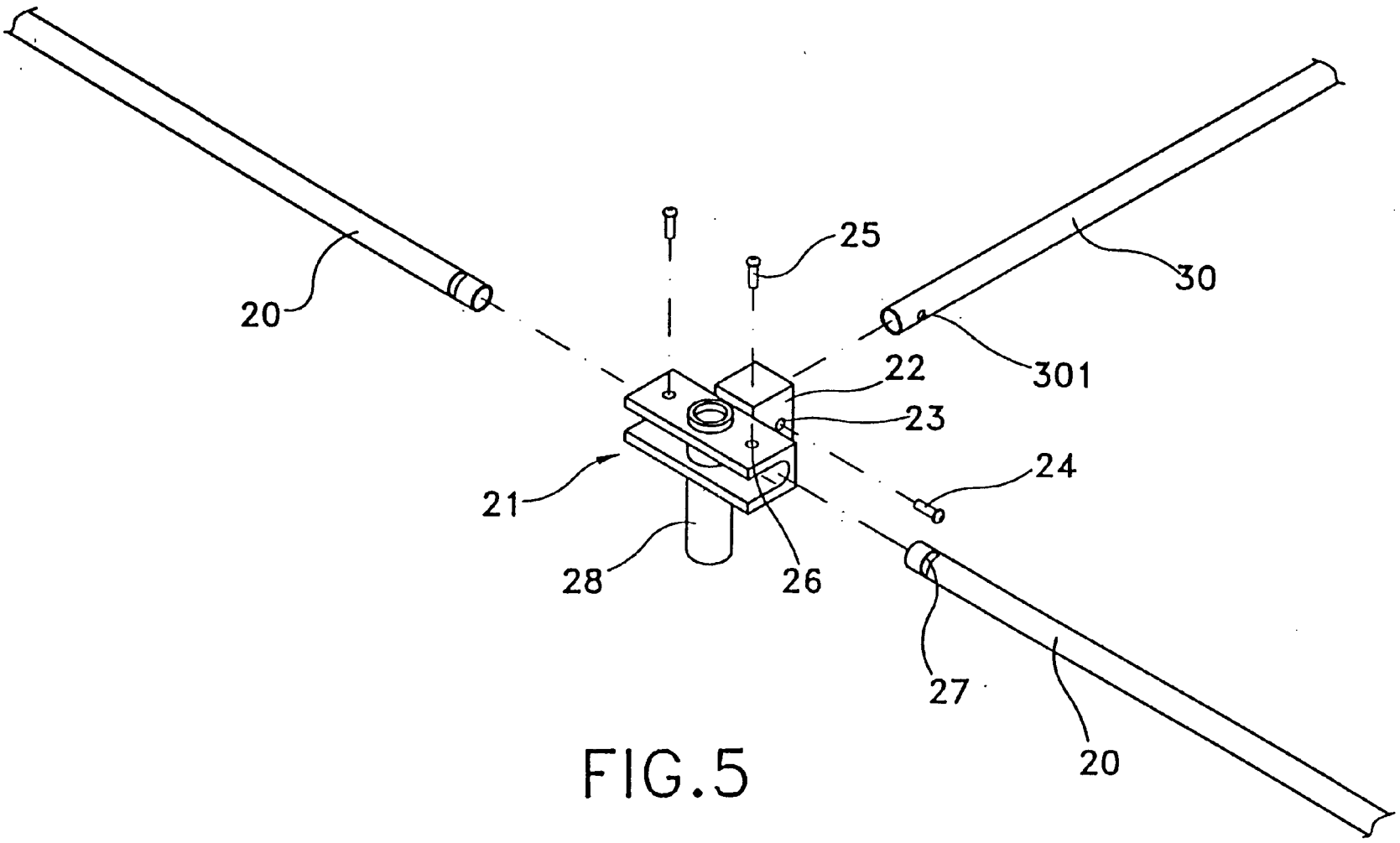
FIG. 5 is an exploded view of the middle unit in the invention.

The invention relates to a "cradle base collapsible mechanism", as shown in FIGS. 1 to 7, wherein a cradle base 1 comprises four sides 2, each side 2 being composed of two support rods 20 that are joined by a middle unit 21, each corner of the cradle base 1 being respectively composed of a corner piece 10 that is joined to one end of the support rod 20, the other end of the support rod 20 being joined by a rivet 29 to a joining unit 11 on the corner piece 10, the joining unit 11 being opened upward and outward, the corner piece 10 including a support leg 12 that extends downward to elevate the whole unit, the bottom ends of the support legs 12 being in contact with the floor, on the corner piece 10 is a receptacle 13 to be fitted with a support post 14; on the inside of each middle unit 21 is a rod holder 22 to which a middle rod 30 is joined, normally by a rivet 24 that runs through the holes 23 on two sides of the rod holder 22 and a hole 301 on the middle rod 30; thus the other end of each middle rod 30 is joined respectively with one side of the center unit 3.

One end of the middle rod 30 facing the center unit 3 is a fixing unit 4 which involves a butt end 40, on the other end of the fixing unit 4 is a flange 41 which is to be inserted to the rod opening 31 of the middle rod 30, between the fixing unit 4 and a protruded catch unit 33 of the center piece 3, a rivet 49 is inserted through the holes 303 on two sides of the middle rod 30 and the holes 34 on two sides of the catch unit 33 and the through hole 43 of the fixing unit to fix a slide block 44. The said rivet 49 running through the oval through hole 45 on the slide block 44. A spring 48 is located between the slide block 44 and the butt end of the fixing unit 4. The front end of each slide 44 being an oblique section 47 extending from the butt end 46, the oblique section 47 being pushed to the front by the spring 48 to extend an open end 42 of the fixing unit 4, in contact with a corresponding butt end 38 on a pressing plate 37, said pressing plate 37 having a contact end facing each middle rod. Since the bottom side of the center piece 3 shown in the drawing is a post 36 that tapers downward to enable an elevation, the bottom of the tapered post 36 in contact with the floor; the bottom inside of the center piece 3 or reinforcing ribs having an exterior "#" shape can be used to form a rhomb with depressed sides, each depressed side is a peripheral side 32 in an arched line shape, respectively in connection with the neighboring catch unit 33, while the catch unit is opened outward and downward, its two sides joined with the middle rod 30, so the middle rod 30 will move downward when it is collapsed.

Figure 6:
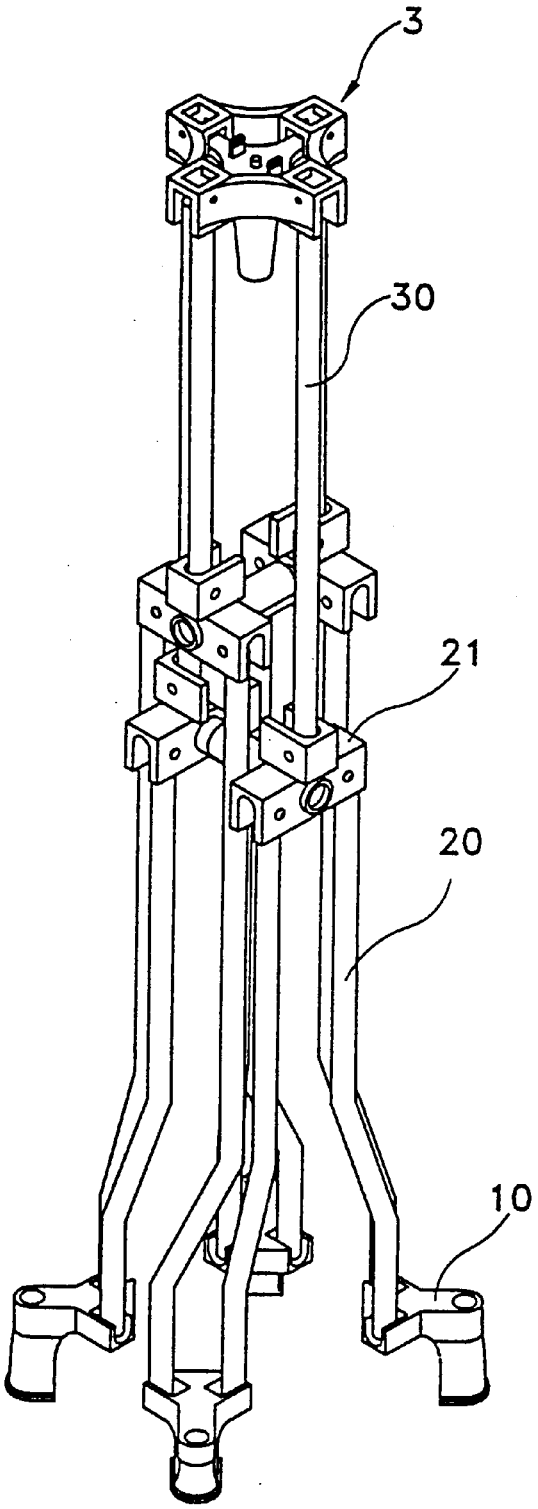
FIG. 6 is a view of the middle unit and the center unit of the invention when they are collapsed.

When the user wishes to collapse the middle rods and the support rods to become the collapsed status shown in FIG. 6, the butt end 38 of the pressing plate 37 reaches inside the catch unit 33, or, inside the frame 35 of the catch unit, so the pressing plate 37 will not fall off from the top, reserving a space for the pressing plate to move up. At the center of the pressing plate 37 is a hole 371, the hole 371 of the pressing plate 37 is located the fixing post 372 at the center of the surface of the bottom 370 of the center piece. On each of two sides of the hole 371 of the pressing plate 37 is a protruded ear plate 39. The pressing plate 37 may be pulled up when the hole 391 of the ear plate 39 is buckled, or a pull string 19 running through the hole 391 of the two ear plates 39 will facilitate pulling. When the pressing plate 37 is lifted, the part of each butt end 38 will cause the oblique section 47 of the slide block 44 to be pushed, meanwhile each slide block 44 depress each spring 43 to retract, so the slide block slides and retracts in the oval hole 45, the slide block no longer inserted in the frame 35 of the catch unit 33, each middle rod 30 rotates and straightens down along with the upward movement of the center piece 3, then the middle piece 21 will overturn 90 degrees upward and inward, so each support rod 20 will be pulled up and is straightened.

Figure 7:
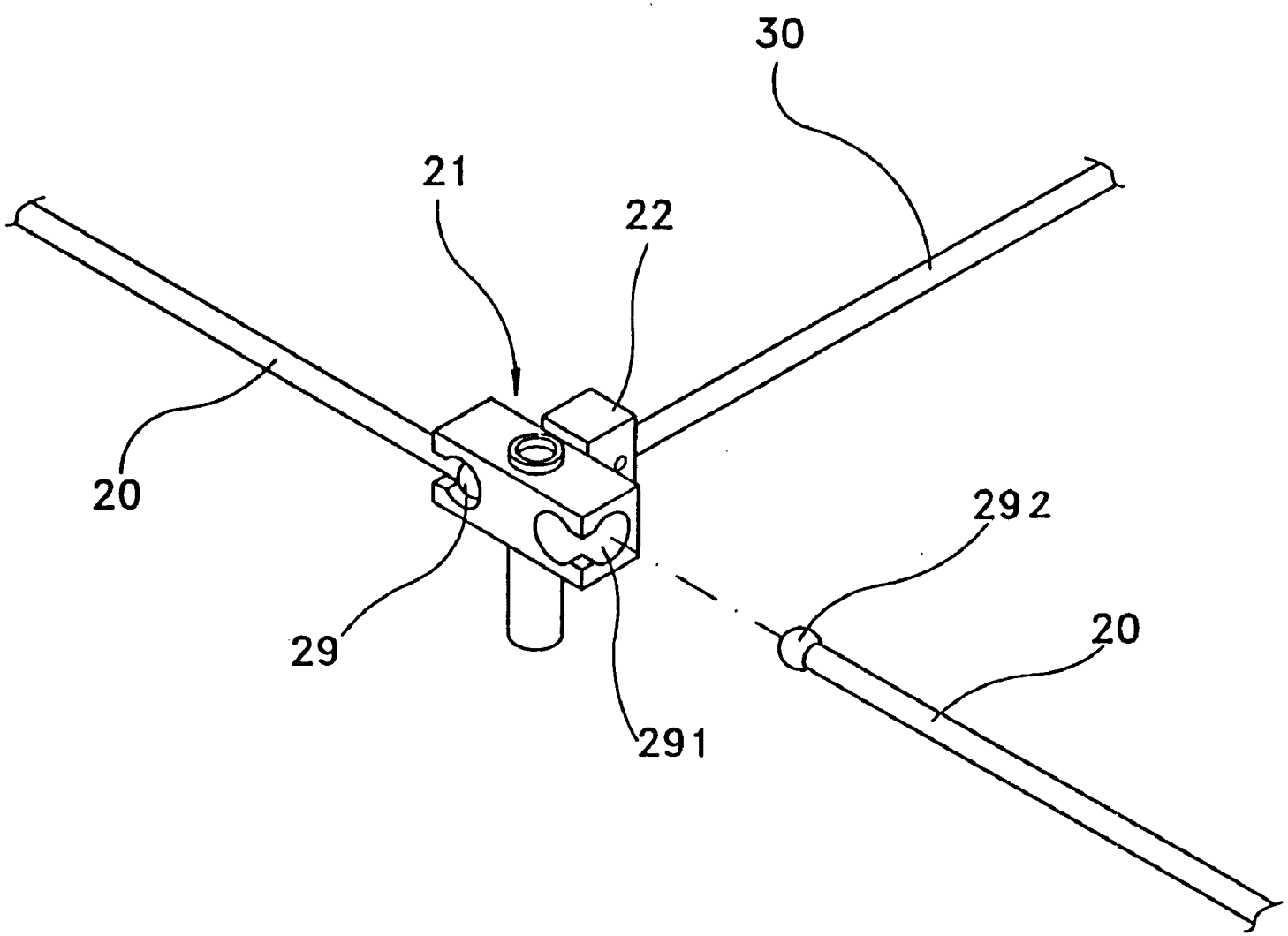
FIG. 7 is another embodiment view of the support rod and middle unit in the invention.
Figure 8:
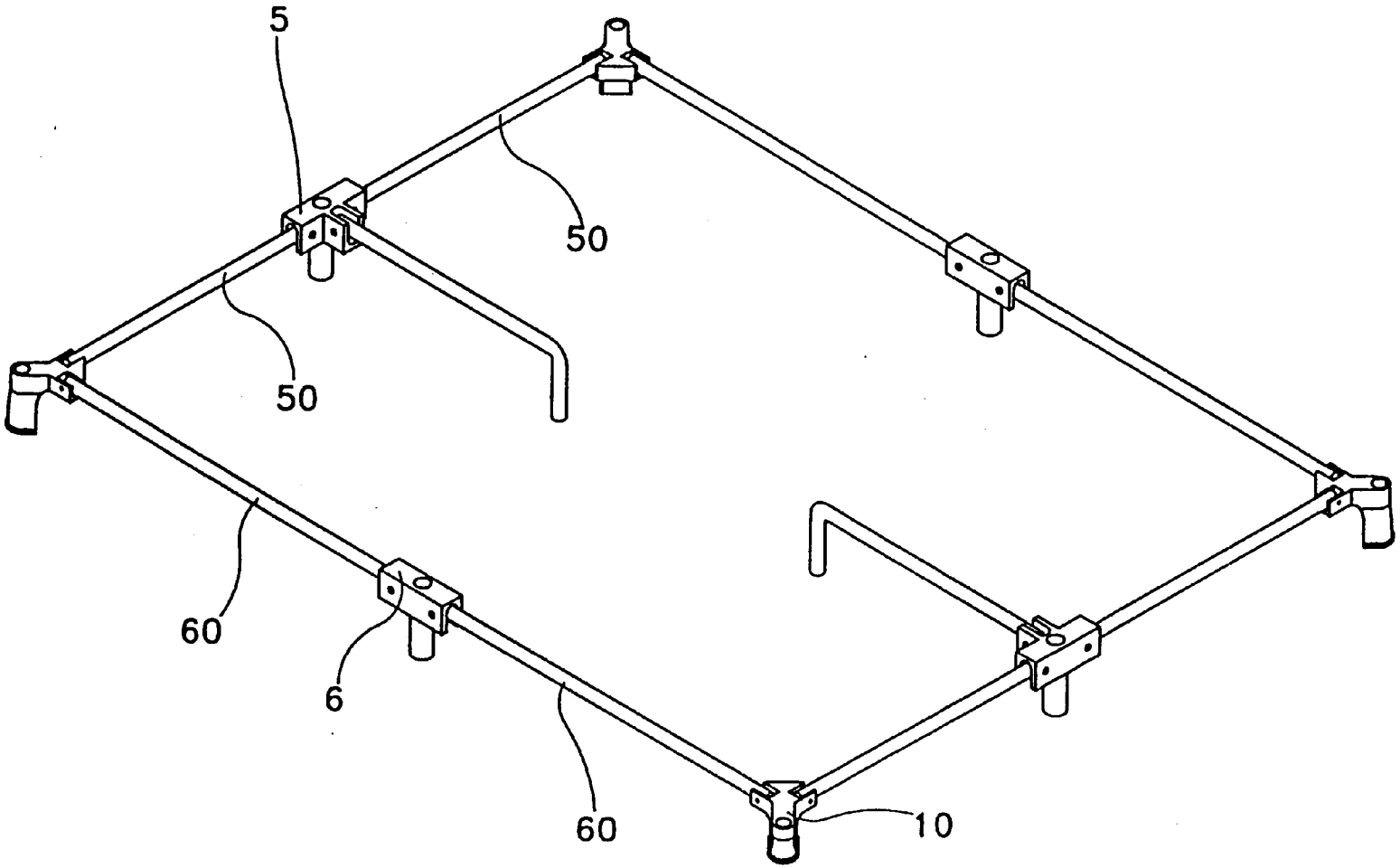
FIG. 8 (PRIOR ART)
FIG. 8 is perspective view of the center unit and the middle unit in a prior art.

Another feature of the invention is the installation of middle pieces 21 that are different from the prior art, on two sides of the middle piece 21 are openings facing outward and facing the support rod 20, a rivet 25 running through the hole 26 on the top and bottom of the middle piece and an oval hole 27 at one end of the support rod 20, the length of the oval hole 27 allowing 90-degree turning of the middle piece 21, the middle piece 21 having a fine support leg 28 that faces downward, the fine support leg serving to enable an elevation and in contact with the floor. Another embodiment of the middle piece is shown in FIG. 7, wherein said middle piece 21 and the support rod end 20 are joined in a way that in the middle piece 21 is the formation of a ball unit 201 in connection with the ball end 292 of the support rod 20. Each support rod 20 retracts slightly to form a "Z" shape, so there is a base plate that can be placed between the two sides composed by the support rods 29, to have a better supporting performance.

As described above, the main functions of the invention include: the whole structure of the cradle base involves a frame containing a cross unit, each side rod being retracted inward slightly to facilitate the placement of a base plate, to reinforce its support strength, while the center unit is so designed that the engaged support rods could not be loosened unless after the center unit is opened, while the two side support rods are depressed by the middle pieces in connection with the middle of each support rod on four sides, so only after the middle rods in connection with the center piece are driven, the middle pieces will be driven to fold up ninety degrees, to loosen the engagement of the support rods, thus the whole structure is designed with consideration of its operational safety, so the support rods will not be moved by an upward pulling force or an outside depressing force, the pressing plate in the center unit and its corresponding slide block must be moved effectively, to accurately and simultaneously release the middle rods joined to all sides of the center unit, the operation can be controlled single-handedly to ensure accurate operation, with its safety considerations, the cradle will not be activated by mistake, so it is highly safe and convenient in actual application, therefore, the integral construction of the invention has its applicability and is easier in operation than a prior art.

The above description covers only the preferred embodiment of the invention, which shall not be based to restrict the characteristics of the invention, so that all equivalent modifications easily conceivable to those skillful in the art shall be included in the intent and scope of the invention.

I claim:

1. A cradle base collapsible mechanism, comprising four sides at the bottom of a baby cradle, each of said four sides being composed by two support rods joined at a first end of each support rod by a middle unit, there being a plurality of middle units in said cradle base, each corner of the cradle base being composed of a corner piece that is joined to a second end of each support rod, each middle unit having an inside part joined to one end of a middle rod, another end of each middle rod being joined to a center unit, said another end of the middle rod facing the center unit being fitted with a fixing unit having a flange, said fixing unit containing a slide block, a spring positioned between the slide block and a bottom side of the fixing unit, the slide block having a front surface being an oblique surface that extends the fixing unit, the fixing unit of said slide block and the middle rod begin joined to the center unit by a catch unit, so that the oblique surface extends to inside said catch unit, and being joined to a butt end corresponding to a press plate, the butt end of the press plate extending to a frame, and to a middle of the press plate to an ear plate, so that when the press plate is lifted up at said ear plate, the slide block will retract, the middle rod will turn down to elevate the middle unit and each support rod will be pulled up.

2. The cradle base collapsible mechanism, as recited in claim 1, wherein the support rod on each side retracts slightly to form a "Z" shape.

3. The cradle base collapsible mechanism, as recited in claim 1, wherein said middle unit and the support rod end are joined in a way that inside the middle unit is the formation of a ball unit in connection with a ball end of the support rod.

4. The cradle base collapsible mechanism, as recited in claim 1, wherein said center unit has a downwardly tapered post, the middle unit has a downward fine support leg, and the corner piece has a downward coarse support leg.

5. The cradle base collapsible mechanism, as recited in claim 1, wherein a pull string runs through the ear plate of the pressing plate of said center unit.

* * * * *